US008272799B1

(12) United States Patent
Yard

(10) Patent No.: US 8,272,799 B1
(45) Date of Patent: Sep. 25, 2012

(54) PORTABLE BACK SCRUBBING DEVICE

(76) Inventor: David G. Yard, Springfield, MA (US)

( * ) Notice: Subject to any disclaimer, the term of this patent is extended or adjusted under 35 U.S.C. 154(b) by 0 days.

(21) Appl. No.: 13/040,530

(22) Filed: Mar. 4, 2011

(51) Int. Cl.
*A46B 5/02* (2006.01)

(52) U.S. Cl. ..... 401/6; 4/606; 15/21.1

(58) Field of Classification Search ..... 401/6, 195; 4/559, 606; 15/21.1
See application file for complete search history.

(56) References Cited

U.S. PATENT DOCUMENTS

| | | | |
|---|---|---|---|
| 5,345,640 | A | 9/1994 | Goss |
| 6,418,574 | B2 | 7/2002 | McDowell |
| 6,662,386 | B1 | 12/2003 | Bowerman |
| 6,996,861 | B1 | 2/2006 | Clark, Jr. |
| 7,451,513 | B2 | 11/2008 | Torres |

FOREIGN PATENT DOCUMENTS

GB 2181043 A * 4/1987

* cited by examiner

*Primary Examiner* — Tuan N Nguyen

(57) ABSTRACT

The portable back scrubbing device provides a polygon frame with beveled edge with perimeter lighting, as well as spaced apart lighting. The device stresses aesthetic appeal, lighting for ease of use in a shower, for example, and a plurality of scrubbing options. The plurality of scrubbing pads is provided in different pads that may be provided in varied heights and widths. Some pads are capable of opposite rotations of other pads for greater effectiveness in any use. The numerous suction cups provide for ensured, removable attachment to many surfaces. The various controls provide for rotation of the circular platform and for rotation of the platform brushes to be opposite that of the platform. Of the many functions, the circular platform motor may also provide for vibration of the pads. Soap control provides for control of liquids to be supplied to a plurality of the pads.

3 Claims, 6 Drawing Sheets

PORTABLE BACK SCRUBBING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various back scrubbing and shower massage devices have been provided in the past. None offer the advantages of the present device.

FIELD OF THE INVENTION

The portable back scrubbing device relates to back scrubbers and the like and more especially to a power device that is especially suited to back scrubbing within a shower.

SUMMARY OF THE INVENTION

The general purpose of the portable back scrubbing device, described subsequently in greater detail, is to provide a portable back scrubbing device which has many novel features that result in an improved portable back scrubbing device which is not anticipated, rendered obvious, suggested, or even implied by prior art, either alone or in combination thereof.

To attain this, the portable back scrubbing device provides a polygon frame having a scalloped beveled edge with perimeter lighting, as well as spaced apart lighting. The device stresses aesthetic appeal, lighting for ease of use in a shower, for example, and a plurality of scrubbing options. The plurality of scrubbing pads may be provided in different pads that may be provided in varied heights and widths. Some pads are capable of opposite rotations of other pads for greater effectiveness in any use. The numerous suction cups provide for ensured, removable attachment to many surfaces and especially a shower wall.

The various controls provide for rotation of the circular platform and may provide for rotation of the platform brushes to be opposite that of the platform. The circular platform motor may also provide for vibration of the pads. Pad rotation and vibration are adjustable. Soap control provides for control of liquids to be supplied to a plurality of the pads. The fusion switch provides for a combination of all functions. The display provides for visual feedback of choices and of function settings.

The utility of the device is not limited to shower back scrubbing but may also include but not be limited to floor scrubbing and scrubbing of other desired surfaces. The pads may comprise foam, bristles, sponges, abrasives, and other surfaces and devices appropriate for various uses. The handles importantly provide for handy portability, for controlling positioning of the device on a shower wall or the like, and for using the device for purposes other than stationary back scrubbing and massage.

Thus has been broadly outlined the more important features of the improved portable back scrubbing device so that the detailed description thereof that follows may be better understood and in order that the present contribution to the art may be better appreciated.

An object of the portable back scrubbing device is to provide a portable scrubbing device.

Another object of the portable back scrubbing device is to provide an easily attached and detached scrubbing device.

A further object of the portable back scrubbing device is to provide for ensured, removable attachment to a given object or surface.

An added object of the portable back scrubbing device is to be especially useful in a shower.

And, an object of the portable back scrubbing device is to provide lighting for use in dimly lit or light restricted environments.

These together with additional objects, features and advantages of the improved portable back scrubbing device will be readily apparent to those of ordinary skill in the art upon reading the following detailed description of presently preferred, but nonetheless illustrative, embodiments of the improved portable back scrubbing device when taken in conjunction with the accompanying drawings.

DETAILED DESCRIPTION OF THE DRAWINGS

With reference now to the drawings, and in particular FIGS. 1 through 6 thereof, the principles and concepts of the portable back scrubbing device generally designated by the reference number 10 will be described.

Figure 3:
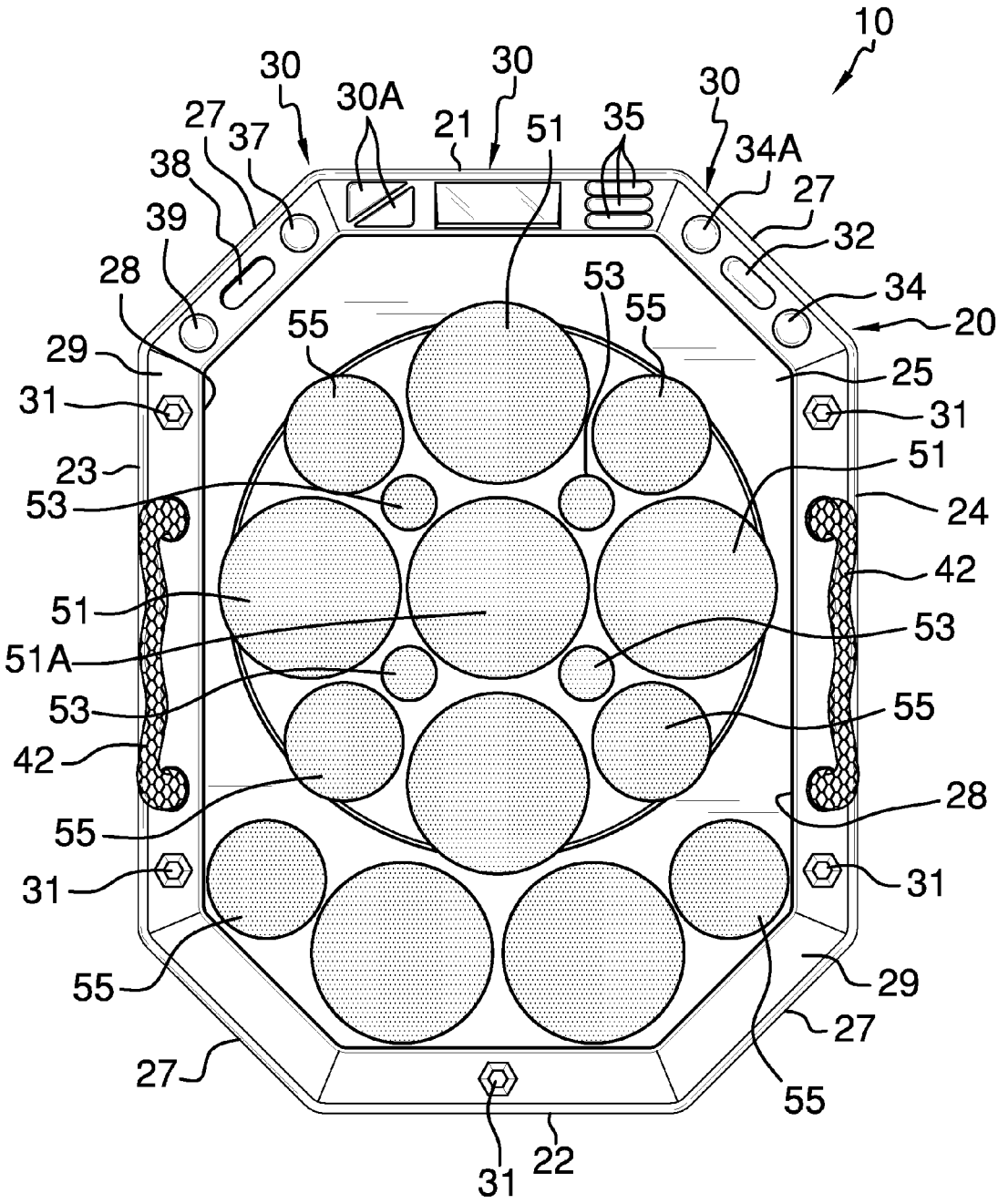
FIG. 3 is a front plan view.
Figure 4:
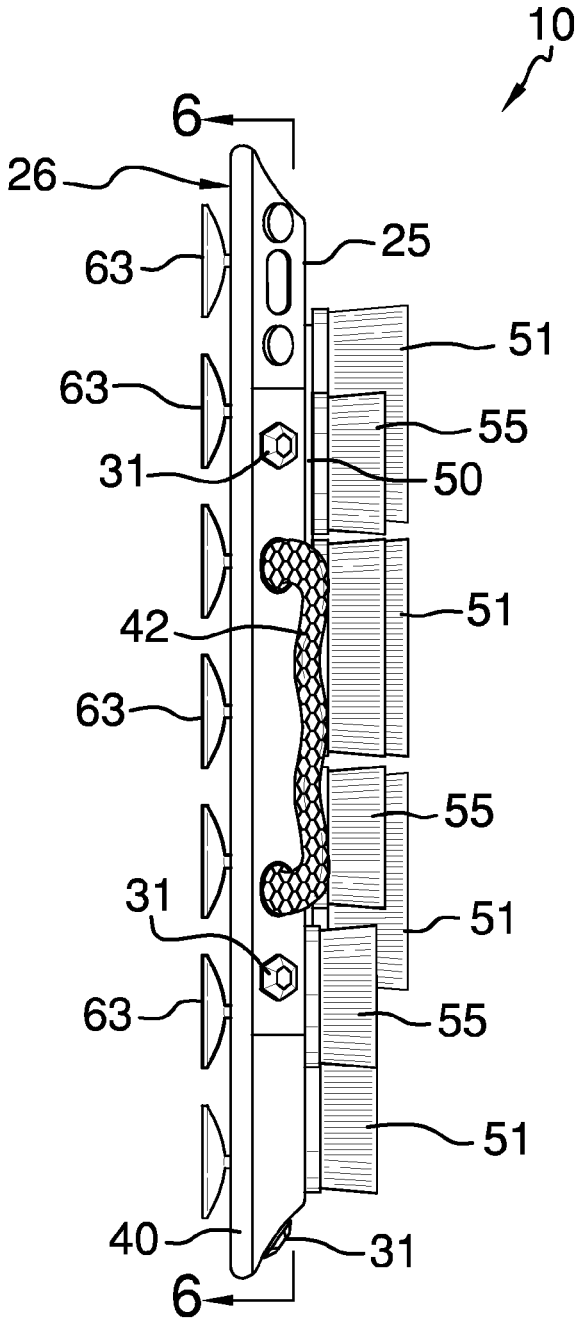
FIG. 4 is a first side elevation view.

Referring to FIG. 3, the device 10 partially comprises the frame 20 having a top 21 spaced apart from a bottom 22, a first side 23 spaced apart from a second side 24, and a front 25 spaced apart from a back 26. The slanted corners 27 join each side to the top 21 and the bottom 22.

Figure 1:
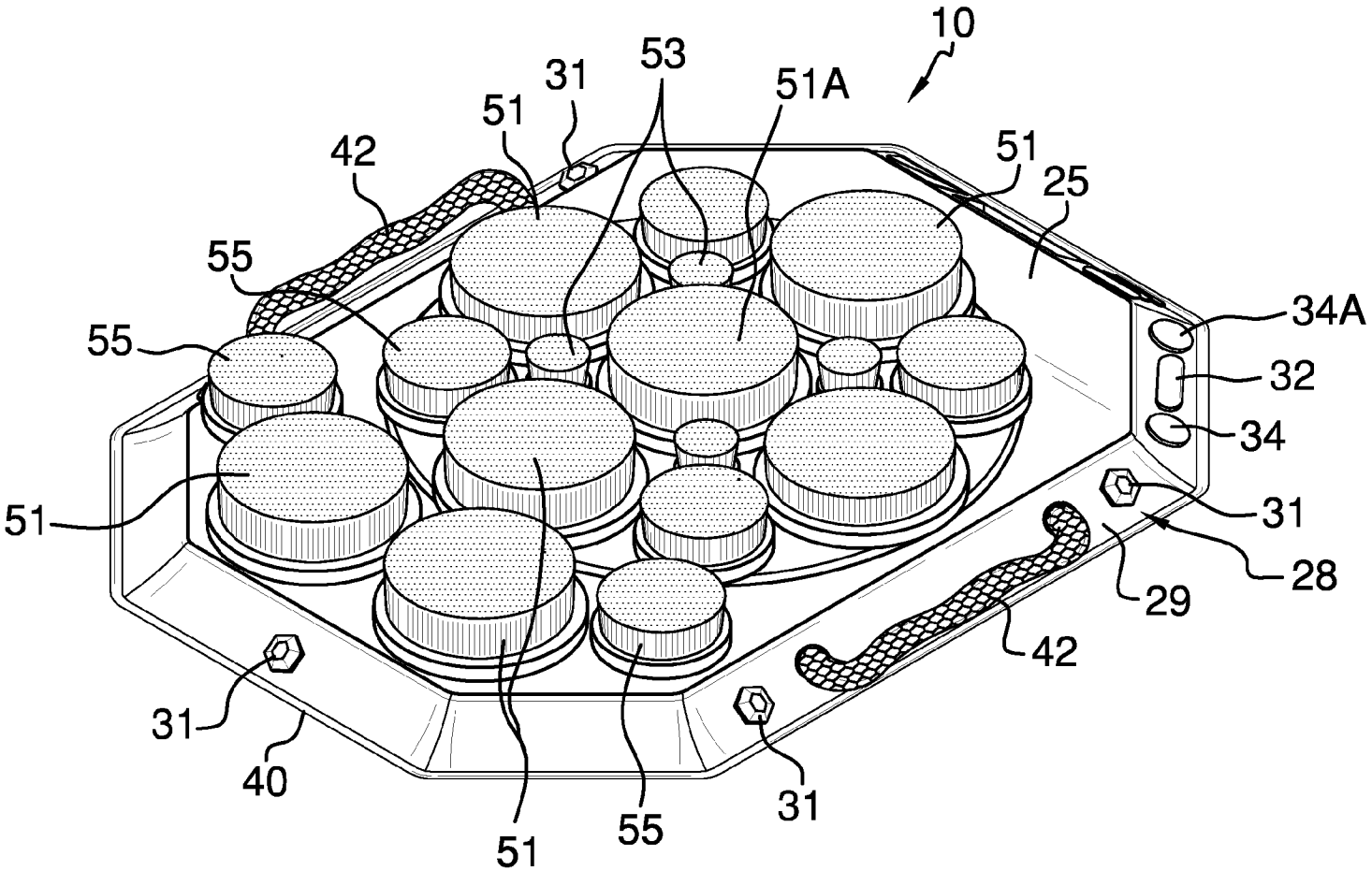
FIG. 1 is a top perspective view.

Referring to FIG. 1, the continuous bevel 28 exteriorly surrounds the frame 20 sides, top 21, bottom 22, and the slanted corners 27. A scallop 29 is disposed within the bevel 28.

Referring again to FIG. 3, the controls 30 are disposed within the bevel 28. The controls 30 are in communication and comprise: an on/off 30A disposed within the scallop 29 at the frame 20 top 21, a plurality of spaced apart lights 31 disposed within the scallop 29, a fusion switch 32 disposed within the scallop 29, a vibrate switch 34 disposed within the scallop 29, a spin switch 34A disposed within the scallop 29, a speed control 35 disposed within the scallop 29, a display 36 disposed within the scallop 29, a soap button 37 disposed within the scallop 29, a fill neck 38 disposed within the scallop 29, and a massage switch 39 disposed within the scallop 29.

Referring to FIG. 1, the perimeter light 40 is disposed outwardly within the frame bevel 28. The plurality of spaced apart lights 31 is disposed within the scallop 29 and is in communication with the controls 30.

Figure 2:
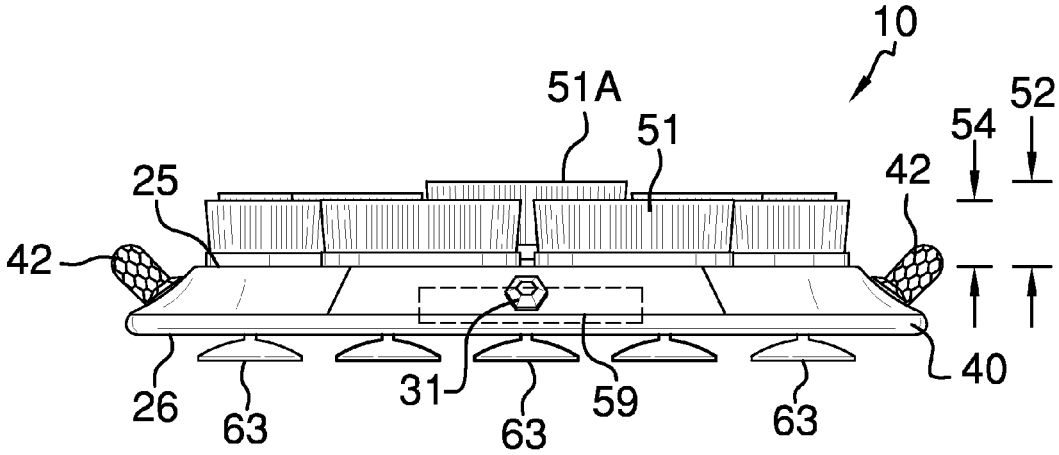
FIG. 2 is a bottom elevation view.

Referring to FIG. 2, a handle 42 is disposed on each of the first side 23 and the second side 24.

Referring again to FIG. 4, the circular platform 50 is disposed within the front 25 in about the center of the frame 20. The circular platform 50 is elevated slightly above the frame 20 front 25.

Referring again to FIG. 3, the quintet of spaced apart wide pads 51 is disposed on the circular platform 50.

Referring to FIG. 2, the circular platform 50 wide pads 51 further comprise a center wide pad 51A having a taller pad height 52. The remaining circular platform 50 wide pads 51 have a shorter pad height 54.

Referring again to FIGS. 2 and 3, the quartet of spaced apart narrow pads 53 is disposed within the circular platform 50 wide pads 51. The narrow pads 53 are disposed around the center wide pad 51A on the circular platform 50. The narrow pads 53 have a shorter pad height 54. The quartet of medium pads 55 is disposed between the circular platform 50 wide pads 51. The medium pads 55 are disposed outwardly on the circular platform 50. The medium pads 55 comprise the shorter pad height 54. A pair of wide pads 51 is disposed side by side on the frame 50 front 25, below the circular platform 50. The wide pads 51 comprise the shorter pad height 54. The pair of spaced apart medium pads 55 is disposed outwardly and slightly upwardly on the frame 20 front 25, adjacent to the frame 20 front 25 wide pads 51 and below the circular platform 50. The medium pads 55 comprise the shorter pad height 54.

Figure 6:
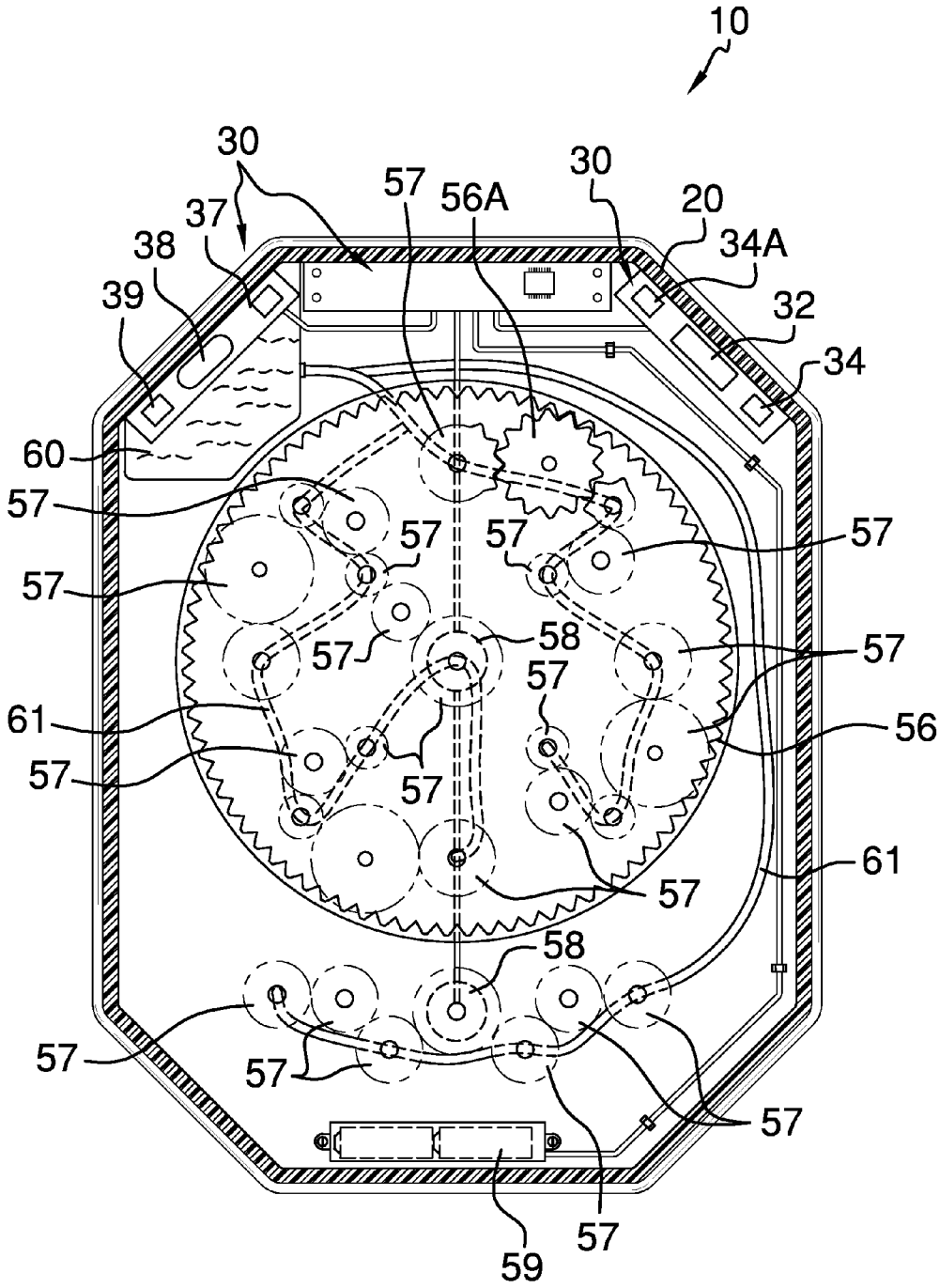
FIG. 6 is a cross sectional view of FIG. 4, taken along the line 6-6.

Referring to FIG. 6, the platform gear 56 is disposed within the frame 20 back 26. The platform gear 56 is affixed to the circular platform 50. The platform drive gear 56A is in communication with the platform gear 56. The plurality of pad drives 57 is disposed within the frame 20 back 26. Each pad drive 57 is in communication with each of the pads. Each pad drive 57 is further in communication with at least one other pad drive 57. Two of the pad drives 57 are in communication with the platform drive gear 56A. A motor 58 is disposed centrally within frame 20 back 26 and is in communication with the center wide pad 51A. The motor 58 further comprises rotation and vibration, selectively. A motor 58 is disposed within the frame 20 back 26 and is in communication with each of the frame 20 front 25 side by side wide pads 51 disposed below the circular platform 50. Via the controls 30, the circular platform 50 rotates in reverse of a rotation of the circular platform 50 pads. The vibrate switch 34 controls the centrally disposed motor 58 vibration. The battery pack 59 is disposed within the frame 20. The battery pack 59 is in communication with the controls 30. The reservoir 60 is disposed within the frame 20 and in direction communication with the fill neck 38. The transfer tube 61 is disposed within the frame 20 back 26 and is in communication with the reservoir 60 and a plurality of the pad drives 57. The controls 30 selectively provide a liquid from the reservoir 60 to the transfer tube 61 equipped pad drives 57.

Figure 5:
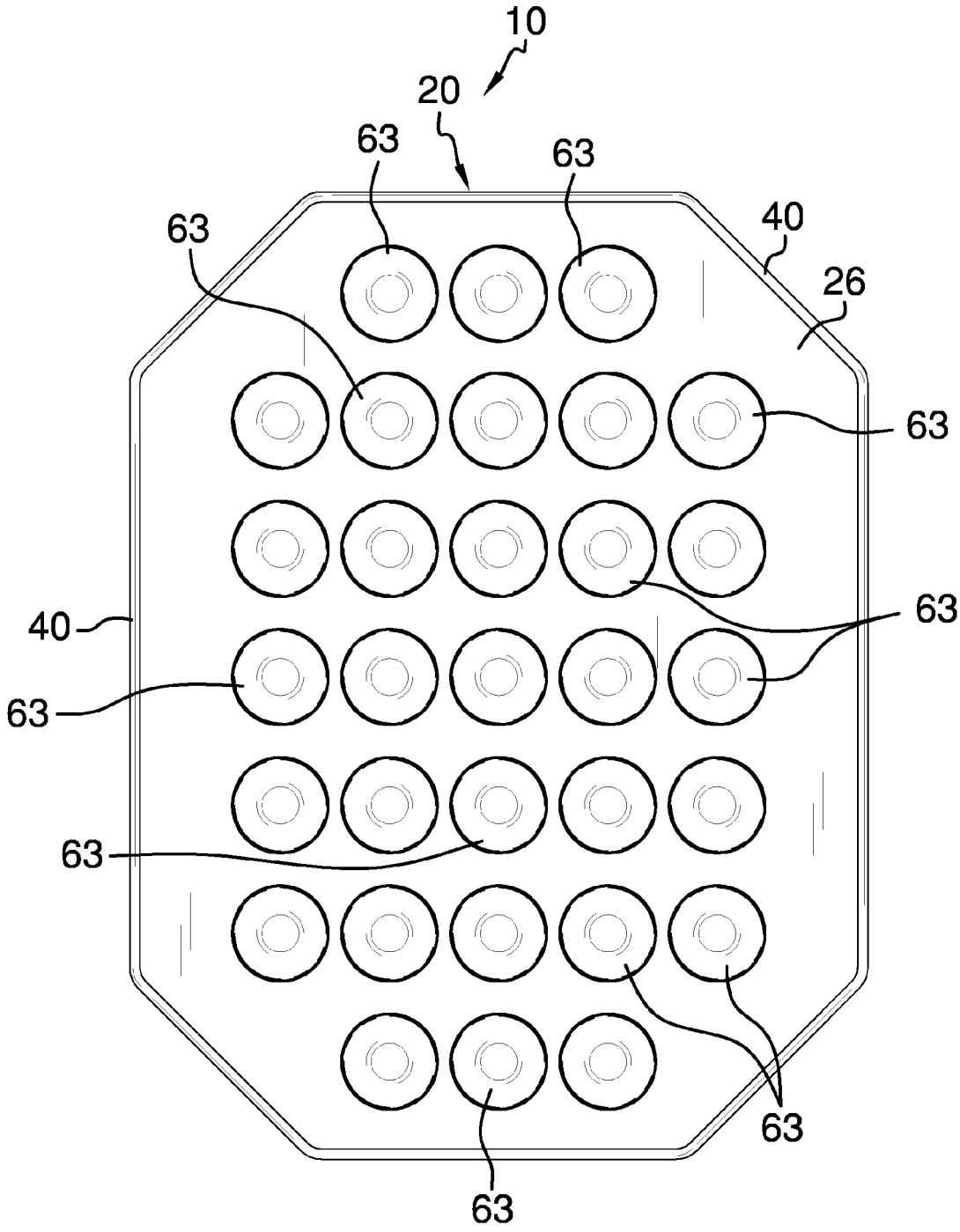
FIG. 5 is a back plan view.

Referring to FIG. 5, the plurality of suction cups 63 is disposed outwardly on the frame 20 back 26.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable back scrubbing device may be used.

What is claimed is:

1. A portable back scrubbing device comprising, in combination:

a frame having a top spaced apart from a bottom, a first side spaced apart from a second side, and a front spaced apart from a back;

a slanted corner joining each side to the top and the bottom;

a continuous bevel exteriorly surrounding the frame sides, top, bottom, and the slanted corners;

a scallop disposed within the bevel;

a controls disposed within the bevel, the controls comprising:

an on/off disposed within the scallop at the frame top;

a plurality of spaced apart lights disposed within the scallop;

a fusion switch disposed within the scallop;

a vibrate switch disposed within the scallop;

a spin switch disposed within the scallop;

a speed control disposed within the scallop;

a display disposed within the scallop;

a soap button disposed within the scallop;

a fill neck disposed within the scallop;

a massage switch disposed within the scallop;

a perimeter light disposed outwardly within the frame bevel and in communication with the controls;

a plurality of spaced apart lights disposed within the scallop and in communication with the controls;

a handle disposed on each of the first side and the second side;

a circular platform disposed within the front in about the center of the frame, the circular platform elevated slightly above the frame front;

a quintet of spaced apart wide pads disposed on the circular platform;

a quartet of spaced apart narrow pads disposed within the circular platform wide pads;

a quartet of medium pads disposed between the circular platform wide pads, the medium pads disposed outwardly on the circular platform;

a pair of wide pads disposed side by side on the frame front, below the circular platform;

a pair of spaced apart medium pads disposed outwardly and slightly upwardly on the frame front, adjacent to the frame front wide pads and below the circular platform;

a platform gear disposed within the frame back, the platform gear affixed to the circular platform;

a platform drive gear in communication with the platform gear;

a plurality of pad drives disposed within the frame back, each pad drive in communication with each of the pads, each pad drive further in communication with at least one other pad drive, two of the pad drives in communication with the platform drive gear;

a motor disposed centrally within frame back and in communication with the center wide pad, the motor further comprising rotation and vibration;

a motor disposed within the frame back and in communication with each of the frame front side by side wide pads disposed below the circular platform;

whereby the circular platform rotates, the vibrate switch controlling the centrally disposed motor vibration;

a battery pack disposed within the frame, the battery pack in communication with the controls;

a reservoir disposed within the frame and in direction communication with the fill neck;

a transfer tube disposed within the frame back and in communication with the reservoir and a plurality of the pad drives, whereby the controls selectively provide a liquid from the reservoir to the transfer tube equipped pad drives;

a plurality of suction cups disposed outwardly on the frame back.

2. The device according to claim 1 wherein the circular platform wide pads further comprise a center wide pad having a taller pad height, the remaining circular platform wide pads having a shorter pad height;

the quartet of spaced apart narrow pads further the shorter pad height;

the quartet of medium pads disposed between the circular platform wide pads further comprising the shorter pad height;

the pair of wide pads disposed side by side on the frame front, below the circular platform, further comprising the shorter pad height;

the pair of spaced apart medium pads disposed outwardly and slightly upwardly on the frame front, adjacent to the frame front wide pads and below the circular platform, further comprising the shorter pad height.

3. A portable back scrubbing device comprising, in combination:

a frame having a top spaced apart from a bottom, a first side spaced apart from a second side, and a front spaced apart from a back;

a slanted corner joining each side to the top and the bottom;

a continuous bevel exteriorly surrounding the frame sides, top, bottom, and the slanted corners;

a scallop disposed within the bevel;

a controls disposed within the bevel, the controls comprising:

an on/off disposed within the scallop at the frame top;

a plurality of spaced apart lights disposed within the scallop;

a fusion switch disposed within the scallop;

a vibrate switch disposed within the scallop;

a spin switch disposed within the scallop;

a speed control disposed within the scallop;

a display disposed within the scallop;

a soap button disposed within the scallop;

a fill neck disposed within the scallop;

a massage switch disposed within the scallop;

a perimeter light disposed outwardly within the frame bevel and in communication with the controls;

a plurality of spaced apart lights disposed within the scallop and in communication with the controls;

a handle disposed on each of the first side and the second side;

a circular platform disposed within the front in about the center of the frame, the circular platform elevated slightly above the frame front;

a quintet of spaced apart wide pads disposed on the circular platform, the circular platform wide pads further comprising a center wide pad having a taller pad height, the remaining circular platform wide pads having a shorter pad height;

a quartet of spaced apart narrow pads disposed within the circular platform wide pads, the narrow pads disposed around the center wide pad on the circular platform, the narrow pads having a shorter pad height;

a quartet of medium pads disposed between the circular platform wide pads, the medium pads disposed outwardly on the circular platform, the medium pads comprising the shorter pad height;

a pair of wide pads disposed side by side on the frame front, below the circular platform, the wide pads comprising the shorter pad height;

a pair of spaced apart medium pads disposed outwardly and slightly upwardly on the frame front, adjacent to the frame front wide pads and below the circular platform, the medium pads comprising the shorter pad height;

a platform gear disposed within the frame back, the platform gear affixed to the circular platform;

a platform drive gear in communication with the platform gear;

a plurality of pad drives disposed within the frame back, each pad drive in communication with each of the pads, each pad drive further in communication with at least one other pad drive, two of the pad drives in communication with the platform drive gear;

a motor disposed centrally within frame back and in communication with the center wide pad, the motor further comprising rotation and vibration;

a motor disposed within the frame back and in communication with each of the frame front side by side wide pads disposed below the circular platform;

whereby the circular platform rotates in reverse of a rotation of the circular platform pads, the vibrate switch controlling the centrally disposed motor vibration;

a battery pack disposed within the frame, the battery pack in communication with the controls;

a reservoir disposed within the frame and in direction communication with the fill neck;

a transfer tube disposed within the frame back and in communication with the reservoir and a plurality of the pad drives, whereby the controls selectively provide a liquid from the reservoir to the transfer tube equipped pad drives;

a plurality of suction cups disposed outwardly on the frame back.

* * * * *